US011705269B2

(12) United States Patent
Yamamoto

(10) Patent No.: US 11,705,269 B2
(45) Date of Patent: Jul. 18, 2023

(54) COIL COMPONENT

(71) Applicant: Murata Manufacturing Co., Ltd., Kyoto-fu (JP)

(72) Inventor: Makoto Yamamoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 554 days.

(21) Appl. No.: 16/830,190

(22) Filed: Mar. 25, 2020

(65) Prior Publication Data

US 2020/0312526 A1 Oct. 1, 2020

(30) Foreign Application Priority Data

Mar. 27, 2019 (JP) ..... 2019-061587

(51) Int. Cl.

| | |
|---|---|
| ***H01F 27/28*** | (2006.01) |
| ***H01F 27/255*** | (2006.01) |
| ***H01F 41/04*** | (2006.01) |
| ***H01F 41/02*** | (2006.01) |
| ***H01F 27/29*** | (2006.01) |

(52) U.S. Cl.

CPC ..... *H01F 27/2804* (2013.01); *H01F 27/255* (2013.01); *H01F 27/29* (2013.01); *H01F 41/0206* (2013.01); *H01F 41/041* (2013.01); *H01F 2027/2809* (2013.01)

(58) Field of Classification Search

CPC .... H01F 27/2804; H01F 27/255; H01F 27/29; H01F 41/0206; H01F 41/041; H01F 2027/2809

See application file for complete search history.

(56) References Cited

U.S. PATENT DOCUMENTS

| | | | | |
|---|---|---|---|---|
| 9,905,349 | B2 * | 2/2018 | Park | H01F 27/02 |
| 10,978,235 | B2 * | 4/2021 | Jeong | H01F 3/08 |
| 2016/0180995 | A1 * | 6/2016 | Park | H01F 17/0013 29/606 |
| 2016/0276088 | A1 * | 9/2016 | Kwon | H01F 27/292 |

FOREIGN PATENT DOCUMENTS

| | | | |
|---|---|---|---|
| JP | H07-109168 | A | 4/1995 |
| JP | H11-307312 | A | 11/1999 |
| JP | 2011-249774 | A | 12/2011 |
| JP | 2018-006411 | A | 1/2018 |
| JP | 2018-110215 | A | 7/2018 |

* cited by examiner

*Primary Examiner* — Carlos Amaya
(74) *Attorney, Agent, or Firm* — Studebaker & Brackett PC

(57) ABSTRACT

A coil component in which occurrence of plating elongation is further suppressed and an inductance value is higher. A coil component includes an element body including metal magnetic particles, a coil conductor inside the element body, and a plurality of external electrodes on a surface of the element body. The element body has a substantially rectangular parallelepiped shape including upper and lower surfaces substantially orthogonal to a winding axis of the coil conductor, first and second side surfaces facing each other, and third and fourth side surfaces facing each other. An average particle diameter of each of metal magnetic particles constituting the upper surface, metal magnetic particles constituting the lower surface, metal magnetic particles constituting the first side surface, and metal magnetic particles constituting the second side surface is smaller than an average particle diameter of metal magnetic particles existing inside a winding portion of the coil conductor.

20 Claims, 7 Drawing Sheets

COIL COMPONENT

CROSS-REFERENCE TO RELATED APPLICATION

This application claims benefit of priority to Japanese Patent Application No. 2019-061587, filed Mar. 27, 2019, the entire content of which is incorporated herein by reference.

BACKGROUND

Technical Field

The present disclosure relates to a coil component.

Background Art

Metal magnetic particles are used as a magnetic material constituting a coil component such as an inductor. JP 2011-249774 A discloses a coil-type electronic component having a coil inside or on the surface of an element body. The element body is composed of particles of soft magnetic alloy containing elements that are more easily oxidized than iron, silicon, and iron. An oxide layer formed by oxidizing the particle is generated on the surface of each soft magnetic alloy particle, and the oxide layer contains a large amount of elements that are more easily oxidized than iron compared to the alloy particles. The particles are connected with the oxide layers interposed therebetween.

SUMMARY

When an external electrode of the coil component is formed by plating, abnormal plating deposition (so-called plating elongation) may occur. On the other hand, the coil component is required to have a high inductance value.

The present inventor has found that it is difficult to achieve both a suppression of the occurrence of plating elongation and a high inductance value in a coil component manufactured using metal magnetic particles.

Accordingly, the present disclosure provides a coil component in which the occurrence of plating elongation is further suppressed and which has a higher inductance value.

The present inventor pays attention to the particle diameter of the metal magnetic particles contained in the coil component, and controls the particle diameter and arrangement of the metal magnetic particles, thereby suppressing the occurrence of plating elongation and increasing the inductance value. The inventors have found that the above can be attained, and have completed the present disclosure.

According to one aspect of the present disclosure, there is provided a coil component including an element body including metal magnetic particles; a coil conductor arranged inside the element body; and a plurality of external electrodes arranged on a surface of the element body. The element body has a substantially rectangular parallelepiped shape including an upper surface and a lower surface that are substantially orthogonal to a winding axis of the coil conductor, a first side surface and a second side surface that face each other, and a third side surface and a fourth side surface that face each other. An average particle diameter of each of metal magnetic particles constituting the upper surface, metal magnetic particles constituting the lower surface, metal magnetic particles constituting the first side surface, and metal magnetic particles constituting the second side surface is smaller than an average particle diameter of metal magnetic particles existing inside a winding portion of the coil conductor.

Since the coil component according to the present disclosure has the above characteristics, occurrence of plating elongation is further suppressed and an inductance value is higher.

DETAILED DESCRIPTION

Hereinafter, a coil component according to an embodiment of the present disclosure will be described in detail with reference to the drawings. However, the shape, arrangement, and the like of the coil component according to the present disclosure and each of its components are not limited to the embodiment described below and the illustrated configuration.

Figure 1:
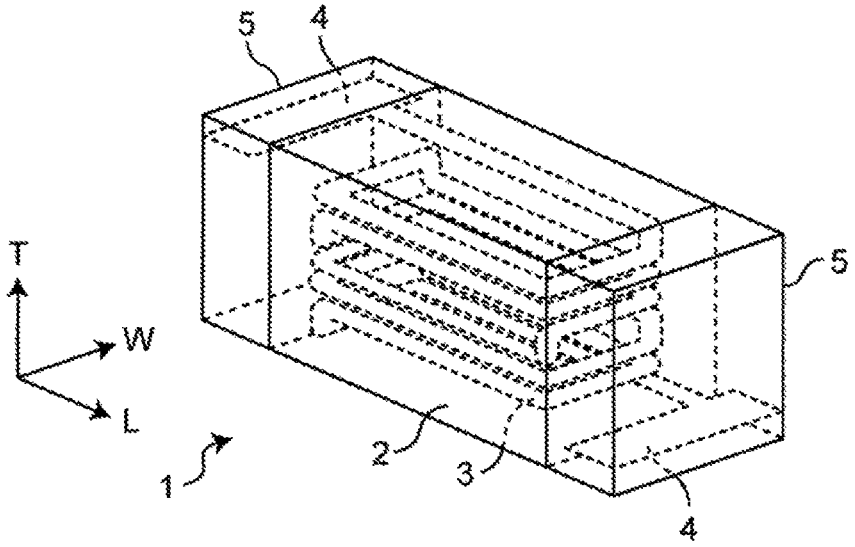
FIG. 1 is a transparent perspective view schematically showing a coil component according to an embodiment of the present disclosure.
Figure 2:
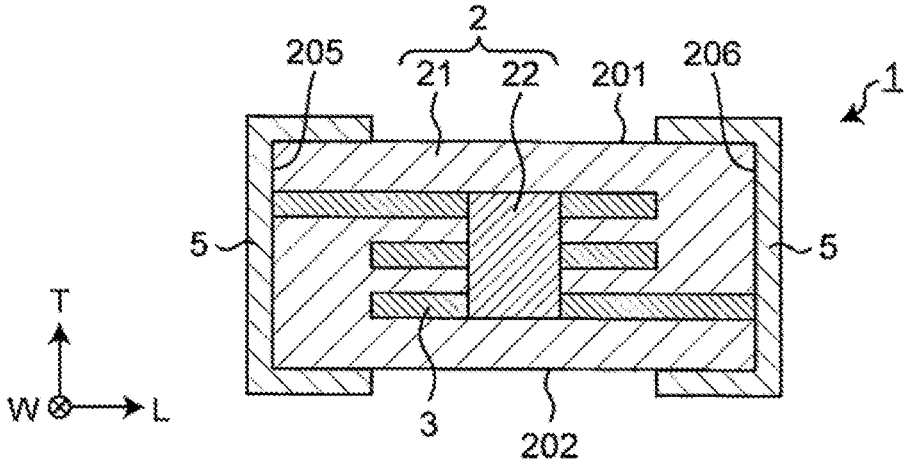
FIG. 2 is a cross-sectional view parallel to the LT plane, schematically showing the coil component shown in FIG. 1.
Figure 3:
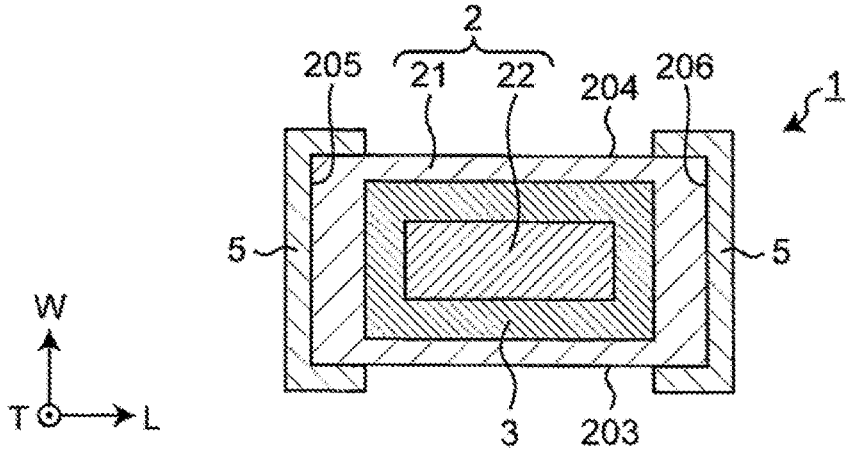
FIG. 3 is a cross-sectional view parallel to the LW plane, schematically showing the coil component shown in FIG. 1.

A transparent perspective view of a coil component 1 according to one embodiment of the present disclosure is shown in FIG. 1, and cross-sectional views of the coil component 1 are schematically shown in FIGS. 2 and 3. The coil component 1 includes an element body 2 containing metal magnetic particles, a coil conductor 3 arranged inside the element body 2, and a plurality of external electrodes 5 arranged on the surface of the element body 2. As illustrated FIGS. 2 and 3, the element body 2 has a substantially rectangular parallelepiped shape including an upper surface 201 and a lower surface 202 that are substantially orthogonal to the winding axis of a coil conductor 3, a first side surface 203 and a second side surface 204 that face each other, and a third side surface 205 and a fourth side surface 206 that face each other. In this specification, "substantially orthogonal" means that it is within a range of 90°±10°, and "rectangular parallelepiped shape" includes a cube. In this specification, the length of the coil component 1 may be referred to as "L", the width as "W", and the thickness (height) as "T" (see FIG. 1). Further, in this specification, the direction parallel to the length L of the coil component 1 is referred to as "L direction", the direction parallel to the width W as "W direction", and the direction parallel to the thickness T as "T direction", and a plane parallel to the L direction and the T direction may be referred to as an "LT plane", a plane parallel to the W direction and the T direction may be referred to as a "WT plane", and a plane parallel to the L direction and the W direction may be referred to as an "LW plane".

The element body 2 contains metal magnetic particles. The average particle diameter of each of the metal magnetic particles constituting the upper surface 201 of the element body 2, the metal magnetic particles constituting the lower surface 202 of the element body 2, the metal magnetic particles constituting the first side surface 203 of the element body 2, and the metal magnetic particles constituting the second side surface 204 of the element body 2 is smaller than the average particle diameter of the metal magnetic particles existing inside the winding portion of the coil conductor. In the configuration example shown in FIGS. 1 to 3, the element body 2 is composed of a first magnetic layer 21 and a second magnetic layer 22. The upper surface 201, the lower surface 202, the first side surface 203, and the second side surface 204 of the element body 2 are each composed of the first magnetic layer 21, and the inside of the winding portion of the coil conductor 3 is composed of the second magnetic layer 22. The average particle diameter of the metal magnetic particles contained in the first magnetic layer 21 is smaller than the average particle diameter of the metal magnetic particles contained in the second magnetic layer 22. Here, the "average particle diameter" of the metal magnetic particles means, in a broad sense, the average value of the particle diameters of the metal magnetic particles measured in the cross section of the element body 2, and in a narrow sense, the average value calculated from the equivalent circle diameter which is obtained by taking a photo of the cross section of the element body 2 with an SEM (scanning electron microscope) and analyzing the obtained image to extract the cross-sectional shape of the metal magnetic particles. Details of the method for measuring the average particle diameter of the metal magnetic particles will be described later.

Figure 16:
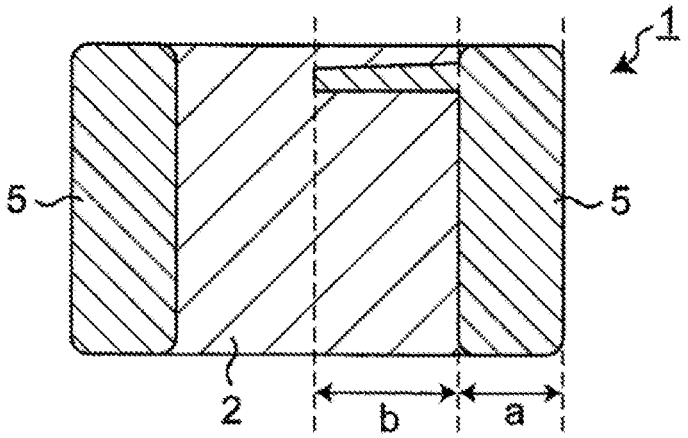
FIG. 16 is a schematic view showing a method for determining plating elongation.

In the coil component 1 shown in FIG. 1, the external electrodes 5 are provided on the third side surface 205 and the fourth side surface 206 of the element body 2, respectively. One of the external electrodes 5 covers the entire surface of the third side surface 205 of the element body 2 and extends to a part of each of the upper surface 201, the lower surface 202, the first side surface 203, and the second side surface 204. The other of the external electrodes 5 covers the entire surface of the fourth side surface 206 of the element body 2 and extends to a part of each of the upper surface 201, the lower surface 202, the first side surface 203, and the second side surface 204. On the other hand, each of the upper surface 201, the lower surface 202, the first side surface 203, and the second side surface 204 of the element body 2 are partially exposed. Therefore, when the external electrodes 5 of the coil component 1 are formed by plating, abnormal plating deposition (so-called plating elongation) may occur on the exposed portions of the upper surface 201, the lower surface 202, the first side surface 203, and the second side surface 204 of the element body 2. The plating elongation means that the plating is formed partially (or locally) larger than the intended plating width. As an example of the plating elongation, as shown in FIG. 16, a phenomenon (Indicated by symbol b) that the plating that constitutes the external electrode 5 extends toward the center of the coil component 1 beyond the region (indicated by the symbol a) where the external electrode 5 is to be formed occurs. When plating elongation occurs, mounting failure may occur when the coil component 1 is mounted.

In contrast, in the coil component 1 according to the present embodiment, the average particle diameter of each of the metal magnetic particles constituting the upper surface 201 of the element body 2, the metal magnetic particles constituting the lower surface 202 of the element body 2, the metal magnetic particles constituting the first side surface 203 of the element body 2, and the metal magnetic particles constituting the second side surface 204 of the element body 2 is smaller than the average particle diameter of the metal magnetic particles existing inside the winding portion of the coil conductor 3. Therefore, it is possible to further suppress the occurrence of plating elongation and the coil component 1 has a higher inductance value.

The reason why it is possible to achieve both higher suppression of the occurrence of plating elongation and a higher inductance value is not bound by a specific theory, but is presumed to be due to the mechanism described below. The larger the particle diameter of the metal magnetic particles constituting the element body, the higher the permeability of the element body, so that the inductance value of the coil component can be increased. However, since the number of grain boundaries having high resistance decreases as the particle diameter of the metal magnetic particles contained in the element body increases, the volume resistivity of the element body tends to decrease. As the volume resistivity of the element body decreases, the plating elongation easily occurs. On the other hand, as the particle diameter of the metal magnetic particles constituting the element body is reduced, the volume resistivity of the element body increases and plating elongation can be suppressed, but the permeability of the element body decreases. Therefore, the inductance value of the coil component tends to be low. Therefore, it is difficult to achieve both suppression of plating elongation and attaining a high inductance value.

On the other hand, in the coil component 1 according to the present embodiment, the metal magnetic particles having a relatively large average particle diameter are arranged inside the winding portion of the coil conductor 3 (that is, the magnetic core portion), and the metal magnetic particles having a relatively small average particle diameter are arranged on the upper surface 201, the lower surface 202, the first side surface 203, and the second side surface 204 (that is, the surface of the element body 2) of the element body 2. For example, in the configuration examples shown in FIGS. 1 to 3, the second magnetic layer 22 containing metal magnetic particles having a relatively large average particle diameter is arranged in the magnetic core portion, and the first magnetic layer 21 containing metal magnetic particles having a relatively small average particle diameter is arranged outside the second magnetic layer 22 to constitute the surface of the element body 2. As described above, by arranging the metal magnetic particles having a relatively large average particle diameter in the magnetic core portion that greatly contributes to the inductance value of the coil component 1, the permeability in the magnetic core portion is improved, and as a result, the inductance value of the coil component 1 can be further increased. Furthermore, by arranging metal magnetic particles having a relatively small average particle diameter on the surface of the element body 2 where plating elongation may occur, the resistance on the surface of the element body 2 can be increased. As a result, the occurrence of plating elongation can be further suppressed while ensuring a higher inductance value.

In the element body 2 of the coil component 1, the average particle diameters of the metal magnetic particles constituting the upper surface 201, the metal magnetic particles constituting the lower surface 202, the metal magnetic particles constituting the first side surface 203, and the metal magnetic particles constituting the second side surface 204 may be the same or different from each other. Even in the case where the average particle diameters of the metal magnetic particles constituting respective surfaces of the element body 2 are different from each other, when the average particle diameters of the metal magnetic particles constituting the respective surfaces are smaller than the average particle diameter of the metal magnetic particles existing in the magnetic core portion, it is possible to obtain the effect of attaining both the suppression of the occurrence of plating elongation and the improvement of the inductance value. Further, on one surface of the element body 2, the particle diameters of the metal magnetic particles constituting the surface may be substantially uniform over the entire surface, or metal magnetic particles having different particle diameters may be distributed. However, it is preferable that the particle diameter distribution of the metal magnetic particles on one surface of the element body 2 is uniform because the effect of suppressing the occurrence of plating elongation on the surface becomes high.

For example, the inductance value of the coil component 1 can be evaluated by measuring the inductance value at a frequency of 10 MHz. The presence or absence of plating elongation in the coil component 1 can be evaluated by visually observing the appearance of the coil component 1. Specifically, as shown in FIG. 16, one in which plating grows larger (indicated by symbol b) than the width of the external electrode 5 (indicated by symbol a) can be evaluated as a defective product due to plating elongation.

In the coil component 1, it is preferable that the average particle diameter of each of the metal magnetic particles constituting the third side surface 205 and the metal magnetic particles constituting the fourth side surface 206 of the element body 2 is smaller than the average particle diameter of the metal magnetic particles existing inside the winding portion of the coil conductor 3. For example, in the configuration example shown in FIGS. 1 to 3, in addition to the upper surface 201, the lower surface 202, the first side surface 203, and the second side surface 204 of the element body 2 of the coil component 1, the third side surface 205 and the fourth side surface 206 are composed of the first magnetic layer 21 containing metal magnetic particles having a relatively small average particle diameter, and the inside of the winding portion of the coil conductor 3 is composed of the second magnetic layer 22 containing metal magnetic particles having a relatively large average particle diameter. With such a configuration, regardless of the shape and positions of the external electrodes 5, the occurrence of plating elongation can be further suppressed, and a higher inductance value can be attained. Such a configuration also has the advantage that it is easier to manufacture. The shape and positions of the external electrodes 5 will be described later. The average particle diameter of each of the metal magnetic particles constituting the third side surface 205 and the metal magnetic particles constituting the fourth side surface 206 of the element body 2 may be the same as the average particle diameters of the metal magnetic particles constituting the upper surface 201, the metal magnetic particles constituting the lower surface 202, the metal magnetic particles constituting the first side surface 203, and the metal magnetic particles constituting the second side surface 204, or the upper surface 201, the lower surface 202, the first side surface 203, the second side surface 204, the third side surface 205, and the fourth side surface 206 of the element body 2 may be composed of metal magnetic particles having different average particle diameters.

It is preferred that the region between a plane that is substantially orthogonal to the winding axis of the coil conductor 3 and is in contact with the upper end of the winding portion and the upper surface 201 of the element body 2 and the region between a plane that is substantially orthogonal to the winding axis of the coil conductor 3 and is in contact with the lower end of the winding portion and the lower surface 202 of the element body 2 are each composed of metal magnetic particles having an average particle diameter smaller than that of the metal magnetic particles existing inside the winding portion. For example, in the configuration example shown in FIGS. 1 to 3, the region between the plane that is substantially orthogonal to the winding axis of the coil conductor 3 and is in contact with the upper end of the winding portion and the upper surface 201 of the element body 2 and the region between the plane that is substantially orthogonal to the winding axis of the coil conductor 3 and is in contact with the lower end of the winding portion and the lower surface 202 of the element body 2 are composed of the first magnetic layer 21 containing metal magnetic particles having a relatively small average particle diameter, and the inside of the winding portion of the coil conductor 3 is composed of the second magnetic layer 22 containing metal magnetic particles having a relatively large average particle diameter. With such a configuration, the strength of the coil component 1 can be improved.

As another configuration example, in the region on the upper side with respect to the plane that is substantially orthogonal to the winding axis of the coil conductor 3 and is in contact with the upper end of the winding portion, metal magnetic particles having an average particle diameter larger than that of the metal magnetic particles constituting the upper surface of the element body 2 may exist, and in the region on the lower side with respect to the plane that is substantially orthogonal to the winding axis of the coil conductor 3 and is in contact with the lower end of the winding portion, metal magnetic particles having an average particle diameter larger than that of the metal magnetic particles constituting the lower surface of the element body 2 may exist. For example, in the coil component 1 shown in FIGS. 5 to 10, the second magnetic layer 22 containing metal magnetic particles having a relatively large average particle diameter is arranged not only inside the winding portion of the coil conductor 3, but also in the region on the upper side with respect to the plane that is substantially orthogonal to the winding axis of the coil conductor 3 and is in contact with the upper end of the winding portion and in the region on the lower side with respect to the plane that is substantially orthogonal to the winding axis of the coil conductor 3 and is in contact with the lower end of the winding portion. With such a configuration, the inductance value of the coil component 1 can be further increased.

The coil conductor 3 may include a plurality of conductor layers laminated in the winding axis direction and electrically connected to each other. In this case, the average particle diameter of each of the metal magnetic particles constituting the upper surface 201 of the element body 2, the metal magnetic particles constituting the lower surface 202, the metal magnetic particles constituting the first side surface 203, and the metal magnetic particles constituting the second side surface 204 may be smaller than the average particle diameter of the metal magnetic particles existing between the conductor layers adjacent in the winding axis direction. In other words, metal magnetic particles having a relatively large average particle diameter may be arranged between the conductor layers constituting the coil conductor 3. For example, in the coil component 1 shown in FIGS. 4, 5, 8, 9, and 10, the second magnetic layer 22 containing metal magnetic particles having a relatively large average particle diameter is arranged not only inside the winding portion of the coil conductor 3, but also between the conductor layers adjacent in the winding axis direction. With such a configuration, the inductance value of the coil component 1 can be further increased.

Further, in the region between the winding portion of the coil conductor 3 and the first side surface 203 of the element body 2, metal magnetic particles having an average particle diameter larger than that of the metal magnetic particles constituting the first side surface 203 may exist, and in the region between the winding portion of the coil conductor 3 and the second side surface 204, metal magnetic particles having an average particle diameter larger than that of the metal magnetic particles constituting the second side surface 204 may exist. Furthermore, when the average particle diameter of each of the metal magnetic particles constituting the third side surface 205 and the metal magnetic particles constituting the fourth side surface 206 of the element body 2 is smaller than the average particle diameter of the metal magnetic particles existing inside the winding portion of the coil conductor 3, in the region between the winding portion of the coil conductor 3 and the third side surface 205, metal magnetic particles having an average particle diameter larger than that of the metal magnetic particles constituting the third side surface 205 may exist, and in the region between the winding portion of the coil conductor 3 and the fourth side surface 206, metal magnetic particles having an average particle diameter larger than that of the metal magnetic particles constituting the fourth side surface 206 may exist. In other words, metal magnetic particles having a relatively large average particle diameter may be arranged outside the winding portion of the coil conductor 3. For example, in the configuration example shown in FIGS. 9 and 10, the second magnetic layer 22 containing metal magnetic particles having a relatively large average particle diameter is arranged not only inside the winding portion of the coil conductor 3, but also in the region between the winding portion of the coil conductor 3 and the first side surface 203 of the element body 2, the region between the winding portion and the second side surface 204, the region between the winding portion and the third side surface 205, and the region between the winding portion and the fourth side surface 206. With such a configuration, the inductance value of the coil component 1 can be further increased.

Next, details of each component of the coil component 1 will be described below.

(Element Body 2)

As shown in FIGS. 1 to 3, the element body 2 has a substantially rectangular parallelepiped shape and contains metal magnetic particles. The average particle diameter of each of the metal magnetic particles constituting the upper surface 201 of the element body 2, the metal magnetic particles constituting the lower surface 202, the metal magnetic particles constituting the first side surface 203, and the metal magnetic particles constituting the second side surface 204 is smaller than the average particle diameter of the metal magnetic particles existing inside the winding portion of the coil conductor 3. In the configuration example shown in FIGS. 1 to 3, the upper surface 201, the lower surface 202, the first side surface 203, the second side surface 204, the third side surface 205, and the fourth side surface 206 of the element body 2 are each composed of the first magnetic layer 21 containing metal magnetic particles having a relatively small average particle diameter, and the inside of the winding portion of the coil conductor 3 is composed of the second magnetic layer 22 containing metal magnetic particles having a relatively large average particle diameter. In the configuration example shown in FIGS. 1 to 3, the element body 2 is composed of the first magnetic layer 21 and the second magnetic layer 22, but the element body 2 may include, in addition to the first magnetic layer 21 and the second magnetic layer 22, one or more magnetic layers containing different types of metal magnetic particles from the metal magnetic particles contained in the first magnetic layer 21 and the second magnetic layer 22.

The metal magnetic material constituting the metal magnetic particles is not particularly limited. For example, there may be used Fe, Fe—Si alloy, Fe—Si—Cr alloy, Fe—Si—Al alloy, Fe—Ni alloy, Fe—Ni—Al alloy, Fe—Cr—Al alloy, amorphous, etc., or a combination thereof. The metal magnetic particles contained in the first magnetic layer 21 and the metal magnetic particles contained in the second magnetic layer 22 may have the same composition or may have different compositions. Further, each of the first magnetic layer 21 and the second magnetic layer 22 may contain one type of metal magnetic particles, or may contain two or more types of metal magnetic particles.

The average particle diameter of the metal magnetic particles contained in the element body 2 is not particularly limited, and can be set as appropriate according to desired characteristics and applications. The average particle diameter of each of the metal magnetic particles constituting the upper surface 201 of the element body 2, the metal magnetic particles constituting the lower surface 202, the metal magnetic particles constituting the first side surface 203, and the metal magnetic particles constituting the second side surface 204 is preferably 10% or more and 80% or less (i.e., from 10% to 80%) of the average particle diameter of the metal magnetic particles existing inside the winding portion of the coil conductor 3. More specifically, the average particle diameter of each of the metal magnetic particles constituting the upper surface 201 of the element body 2, the metal magnetic particles constituting the lower surface 202, the metal magnetic particles constituting the first side surface 203, and the metal magnetic particles constituting the second side surface 204 is preferably 1 μm or more and 12 μm or less (i.e., from 1 μm to 12 μm). The average particle diameter of the metal magnetic particles existing inside the winding portion of the coil conductor 3 is preferably 3 μm or more and 14 μm or less (i.e., from 3 μm to 14 μm). In the configuration example shown in FIGS. 1 to 3, the average particle diameter of the metal magnetic particles contained in the first magnetic layer 21 is preferably 1 μm or more and 12 μm or less (i.e., from 1 μm to 12 μm), and the average particle diameter of the metal magnetic particles contained in the second magnetic layer 22 is preferably 3 μm or more and 14 μm or less (i.e., from 3 μm to 14 μm).

The average particle diameter of the metal magnetic particles contained in the element body 2 can be measured by the procedure described below. First, the coil component 1 is cut to form a cross section. The cross section is a plane cut parallel to the LT plane at a position of ½ of the width W of the coil component 1 or a plane cut parallel to the WT plane at a position of ½ of the length L of the coil component 1. The obtained cross section is mirror polished. An SEM image with a magnification of 1000 is acquired in the cross section after mirror polishing. In addition, the magnification of the SEM image may be suitably changed according to the size of the metal magnetic particles to measure. In the case of measuring the average particle diameter of the metal magnetic particles constituting the surface of the element body 2 (upper surface 201, lower surface 202, first side surface 203, second side surface 204, third side surface 205, or fourth side surface 206), an SEM image is acquired at an arbitrary location near the surface. In the case of measuring the average particle diameter of the metal magnetic particles existing inside the winding portion of the coil conductor 3, an SEM image is acquired at an arbitrary location inside the winding portion. As shown in FIGS. 1 to 3, when the element body 2 is composed of a plurality of magnetic layers, an SEM image is acquired at a location other than the vicinity of the interface of the magnetic layers. The SEM image is binarized using image analysis software, and the contours of the metal magnetic particles are extracted. At this time, only metal magnetic particles whose entire contour fall within the SEM image are analyzed. The equivalent circle diameters of the extracted metal magnetic particles are obtained, and the average value is taken as the average particle diameter of the metal magnetic particles. In the case of measuring the particle diameter in the cross section of the element body 2, depending on the location where the metal magnetic particles are cut, the measured value may be smaller than the actual particle diameter, but the relative magnitude relationship of the metal magnetic particles between the magnetic layers can be determined by the average particle diameter obtained from the cross section of the element body 2.

The coil component 1 can be manufactured by heat-treating the element body 2 as will be described later. In this case, the metal magnetic particles contained in the element body 2 each have an oxide film on the surface. This oxide films are derived from metal magnetic particles and is formed by heat treatment. In the element body 2, adjacent metal magnetic particles are bonded to each other with an oxide film interposed therebetween. In other words, the metal magnetic particles are necked. When heat treatment is performed, the metal magnetic particles are strongly bonded in this way by sintering. In the coil component 1 manufactured by the heat treatment, the problem of plating elongation may become more prominent. Since the coil component 1 of the present embodiment can further suppress the occurrence of plating elongation, the occurrence of plating elongation can be further suppressed even when the coil component 1 is manufactured by heat treatment.

The coil component 1 of the present embodiment may be a laminated coil component. The laminated coil component manufactured by the heat treatment ensures the insulation between the metal magnetic particles and the coil conductor 3 by the oxide films existing on the surface of the metal magnetic particles. Therefore, the density of the metal magnetic particles in the element body 2 can be increased by applying a high pressure with a press before the heat treatment. In the laminated coil component, the problem of plating elongation may become more significant. Since the coil component 1 of the present embodiment can further suppress the occurrence of plating elongation, the occurrence of plating elongation can be further suppressed even when the coil component 1 is a laminated coil component.

(Coil Conductor 3)

The coil conductor 3 includes a plurality of conductor layers laminated in the winding axis direction and electrically connected to each other. One end of the coil conductor 3 is extended to the surface of the element body 2 and is electrically connected to one of the external electrodes 5 with a lead conductor 4 interposed therebetween, and the other end of the coil conductor 3 is extended to the surface of the element body 2 and is electrically connected to the other of the external electrodes 5 with a lead conductor 4 interposed therebetween. The positions where both ends of the coil conductor 3 are extended can be changed as appropriate according to the positions where the external electrodes 5 are provided. The coil conductor 3 may be made of a metal material that is generally used for a laminated element, and may be made of, for example, Ag, Ag—Pd, Cu, Pt, or the like. In the configuration example shown in FIGS. 1 to 3, the coil component 1 includes only one coil conductor 3, but the coil component 1 may include two or more coil conductors 3.

(External Electrodes 5)

Figure 11:
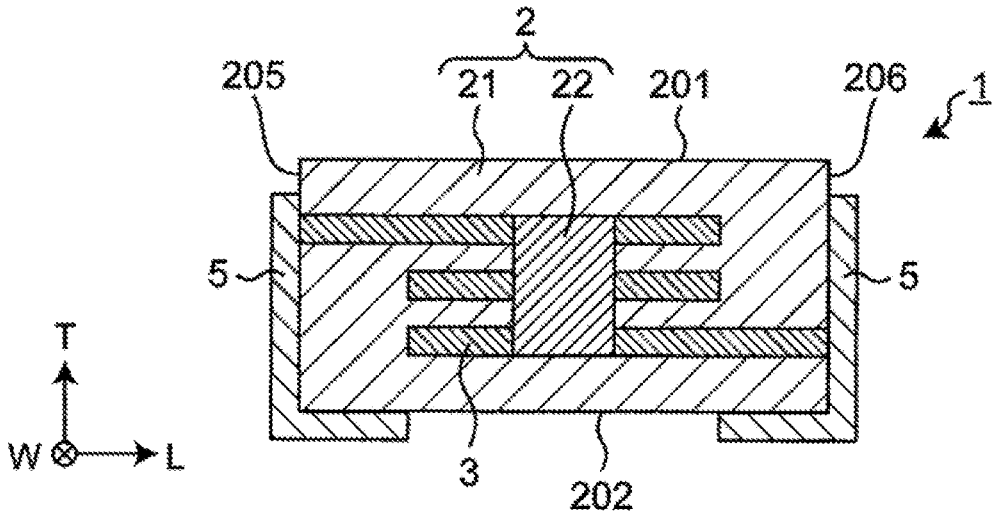
FIG. 11 is a cross-sectional view parallel to the LT plane, schematically showing a seventh modification of the coil component according to the embodiment of the present disclosure.
Figure 12:
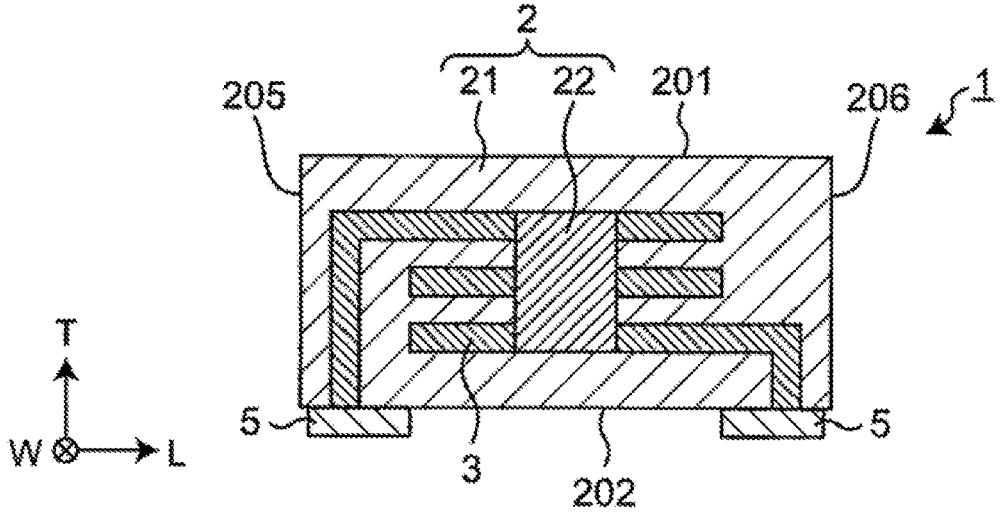
FIG. 12 is a cross-sectional view parallel to the LT plane, schematically showing an eighth modification of the coil component according to the embodiment of the present disclosure.

The coil component 1 includes a plurality of external electrodes 5. The external electrodes 5 are provided for electrical connection between the coil conductor 3 arranged inside the element body 2 and the outside. The number of external electrodes 5 varies depending on the number of coil conductors 3 included in the coil component 1. In the configuration example shown in FIGS. 1 to 3, the coil component 1 includes two external electrodes 5. The shapes and arrangement positions of the external electrodes 5 are not particularly limited, and can be set as appropriate according to the applications. For example, the external electrodes 5 may be provided at both ends of the element body 2 as shown in FIGS. 1 to 3. Alternatively, the external electrode 5 may be an L-shaped electrode provided across the lower surface 202 of the element body 2 and the third side surface 205 or the fourth side surface 206 adjacent to the lower surface 202 as shown in FIG. 11, or may be a bottom electrode provided on the lower surface 202 of the element body 2 as shown in FIG. 12. In the case where the external electrode 5 is an L-shaped electrode as shown in FIG. 11, when the average particle diameter of the metal magnetic particles constituting the lower surface 202 of the element body 2 on which the external electrode 5 is provided, the average particle diameter of the metal magnetic particles constituting the third side surface 205, and the average particle diameter of the metal magnetic particles constituting the fourth side surface 206 are each smaller than the average particle diameter of the metal magnetic particles existing inside the winding portion of the coil conductor 3, the occurrence of plating elongation can be further suppressed, and a higher inductance value can be attained. In the case where the external electrode 5 is a bottom electrode as shown in FIG. 12, when the average particle diameter of the metal magnetic particles constituting the lower surface 202 of the element body 2 on which the external electrode 5 is provided is smaller than the average particle diameter of the metal magnetic particles existing inside the winding portion of the coil conductor 3, the occurrence of plating elongation can be further suppressed, and a higher inductance value can be attained. The external electrode 5 may contain a conductive material such as metal (Ag, Cu, etc.) and a glass component.

Next, modifications of the coil component 1 according to the present embodiment will be described below. However, the configuration of the coil component 1 according to the present embodiment is not limited to the following modifications. In coil components 1 of first to eighth modifications described below, the occurrence of plating elongation is further suppressed and the inductance value is higher.

[First Modification]

Figure 4:
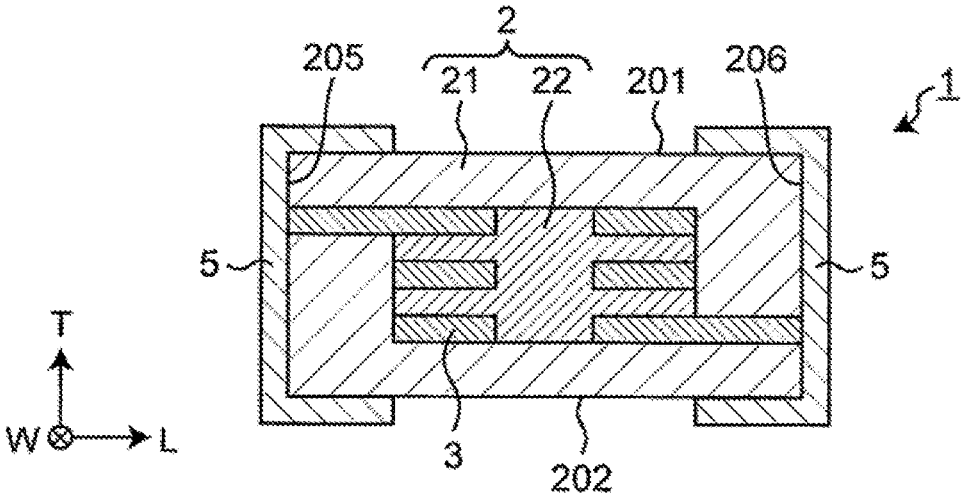
FIG. 4 is a cross-sectional view parallel to the LT plane, schematically showing a first modification of the coil component according to the embodiment of the present disclosure.

FIG. 4 shows a cross-sectional view parallel to the LT plane, schematically showing the coil component 1 of the first modification. The coil component 1 according to the first modification is different from the coil component 1 in FIGS. 1 to 3 in that the average particle diameter of each of the metal magnetic particles constituting the upper surface 201 of the element body 2, the metal magnetic particles constituting the lower surface 202, the metal magnetic particles constituting the first side surface 203, and the metal magnetic particles constituting the second side surface 204 is smaller than the average particle diameter of the metal magnetic particles existing between the conductor layers adjacent in the winding axis direction of the coil conductor 3. In other words, in the coil component 1 of the first modification, the second magnetic layer 22 containing metal magnetic particles having a relatively large average particle diameter is also arranged between the conductor layers constituting the coil conductor 3. The coil component 1 of the first modification has an advantage that the inductance value is further increased as compared with the coil component 1 shown in FIGS. 1 to 3. In addition, the coil component 1 of the first modification has few surfaces where different materials come into contact with each other, and the structure is not complicated. Therefore, the coil component 1 is easy to manufacture and has the same strength as the coil component 1 shown in FIGS. 1 to 3.

[Second Modification]

Figure 5:
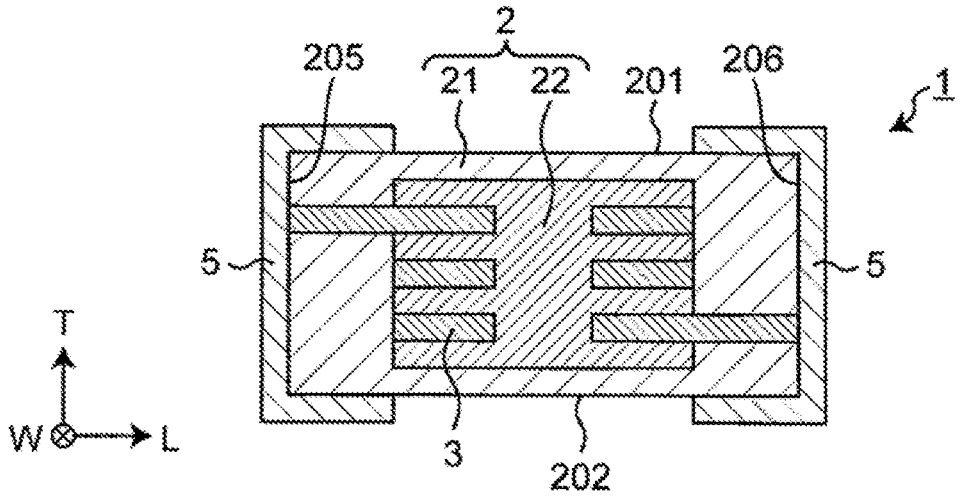
FIG. 5 is a cross-sectional view parallel to the LT plane, schematically showing a second modification of the coil component according to the embodiment of the present disclosure.

FIG. 5 shows a cross-sectional view parallel to the LT plane, schematically showing the coil component 1 of the second modification. The coil component 1 of the second modification is different from the coil component 1 of the first modification in that, in the region on the upper side with respect to the plane that is substantially orthogonal to the winding axis of the coil conductor 3 and is in contact with the upper end of the winding portion, metal magnetic particles having an average particle diameter larger than that of the metal magnetic particles constituting the upper surface of the element body 2 exist, and in the region on the lower side with respect to the plane that is substantially orthogonal to the winding axis of the coil conductor 3 and is in contact with the lower end of the winding portion, metal magnetic particles having an average particle diameter larger than that of the metal magnetic particles constituting the lower surface of the element body 2 exist. In other words, in the coil component 1 of the second modification, the second magnetic layer 22 containing metal magnetic particles having a relatively large average particle diameter is not arranged only to the inside of the winding portion of the coil conductor 3, but also in the region on the upper side with respect to the plane that is substantially orthogonal to the winding axis of the coil conductor 3 and is in contact with the upper end of the winding portion and in the region on the lower side with respect to the plane that is substantially orthogonal to the winding axis of the coil conductor 3 and is in contact with the lower end of the winding portion. The coil component 1 of the second modification has an advantage that the inductance value is further increased as compared with the coil component 1 of the first modification. In addition, since the coil component 1 of the second modification is not complicated in structure, it is easy to manufacture and has the same strength as the coil component 1 of the first modification. In the coil component 1 of the second modification, as shown in FIG. 5, the second magnetic layer 22 is provided so as to cover the upper end and the lower end of the winding portion of the coil conductor 3. Therefore, the coil component 1 of the second modification has a larger volume occupied by the second magnetic layer 22 than the coil component 1 of the fifth modification described later, and thus has a higher inductance value.

[Third Modification]

Figure 6:
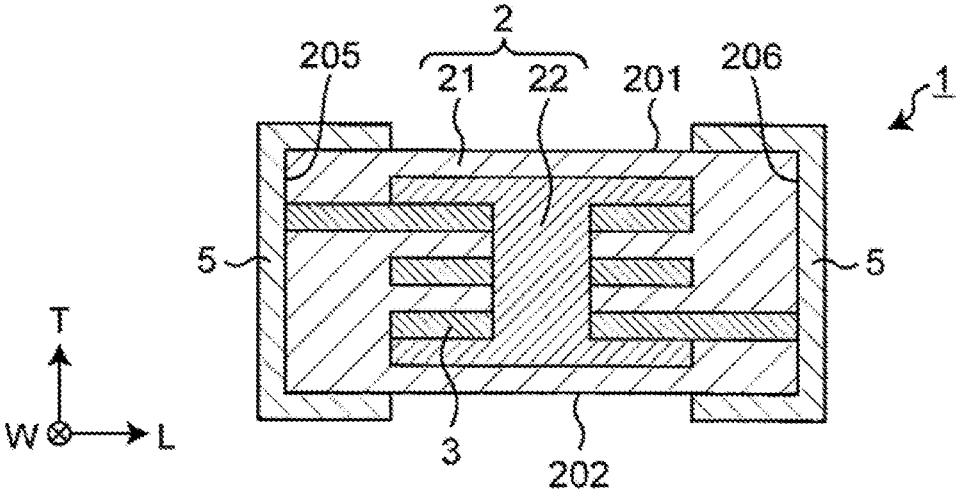
FIG. 6 is a cross-sectional view parallel to the LT plane, schematically showing a third modification of the coil component according to the embodiment of the present disclosure.

FIG. 6 shows a cross-sectional view parallel to the LT plane, schematically showing the coil component 1 of the third modification. The coil component 1 of the third modification is different from the coil component 1 shown in FIGS. 1 to 3 in that, in the region on the upper side with respect to the plane that is substantially orthogonal to the winding axis of the coil conductor 3 and is in contact with the upper end of the winding portion, metal magnetic particles having an average particle diameter larger than that of the metal magnetic particles constituting the upper surface of the element body 2 exist, and in the region on the lower side with respect to the plane that is substantially orthogonal to the winding axis of the coil conductor 3 and is in contact with the lower end of the winding portion, metal magnetic particles having an average particle diameter larger than that of the metal magnetic particles constituting the lower surface of the element body 2 exist. In other words, in the coil component 1 of the third modification, the second magnetic layer 22 containing metal magnetic particles having a relatively large average particle diameter is not arranged only to the inside of the winding portion of the coil conductor 3, but also in the region on the upper side with respect to the plane that is substantially orthogonal to the winding axis of the coil conductor 3 and is in contact with the upper end of the winding portion and in the region on the lower side with respect to the plane that is substantially orthogonal to the winding axis of the coil conductor 3 and is in contact with the lower end of the winding portion. The coil component 1 of the third modification has an advantage that the inductance value is further increased as compared with the coil component 1 shown in FIGS. 1 to 3. In the coil component 1 of the third modification, as shown in FIG. 6, the second magnetic layer 22 is provided so as to cover the upper end and the lower end of the winding portion of the coil conductor 3. Therefore, the coil component 1 of the third modification has a larger volume occupied by the second magnetic layer 22 than the coil component 1 of the fourth modification described later, and thus has a higher inductance value.

[Fourth Modification]

Figure 7:
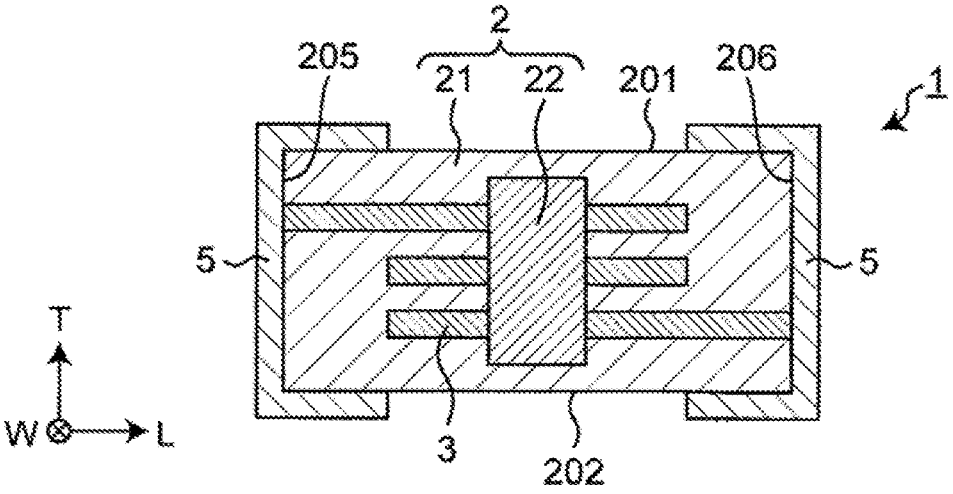
FIG. 7 is a cross-sectional view parallel to the LT plane, schematically showing a fourth modification of the coil component according to the embodiment of the present disclosure.

FIG. 7 shows a cross-sectional view parallel to the LT plane, schematically showing the coil component 1 of the fourth modification. The coil component 1 of the fourth modification is different from the coil component 1 shown in FIGS. 1 to 3 in that, in the region on the upper side with respect to the plane that is substantially orthogonal to the winding axis of the coil conductor 3 and is in contact with the upper end of the winding portion, metal magnetic particles having an average particle diameter larger than that of the metal magnetic particles constituting the upper surface of the element body 2 exist, and in the region on the lower side with respect to the plane that is substantially orthogonal to the winding axis of the coil conductor 3 and is in contact with the lower end of the winding portion, metal magnetic particles having an average particle diameter larger than that of the metal magnetic particles constituting the lower surface of the element body 2 exist. In other words, in the coil component 1 of the fourth modification, the second magnetic layer 22 containing metal magnetic particles having a relatively large average particle diameter is not arranged only to the inside of the winding portion of the coil conductor 3, but also in the region on the upper side with respect to the plane that is substantially orthogonal to the winding axis of the coil conductor 3 and is in contact with the upper end of the winding portion and in the region on the lower side with respect to the plane that is substantially orthogonal to the winding axis of the coil conductor 3 and is in contact with the lower end of the winding portion. The coil component 1 of the fourth modification has an advantage that the inductance value is further increased as compared with the coil component 1 shown in FIGS. 1 to 3.

[Fourth Modification]

Figure 8:
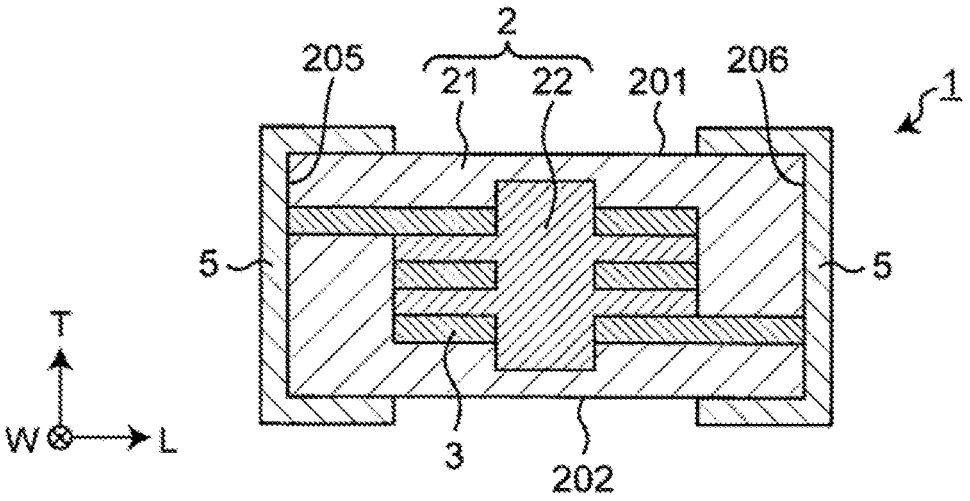
FIG. 8 is a cross-sectional view parallel to the LT plane, schematically showing a fifth modification of the coil component according to the embodiment of the present disclosure.

FIG. 8 shows a cross-sectional view parallel to the LT plane, schematically showing the coil component 1 of the fifth modification. The coil component 1 of the fifth modification is different from the coil component 1 of the first modification in that, in the region on the upper side with respect to the plane that is substantially orthogonal to the winding axis of the coil conductor 3 and is in contact with the upper end of the winding portion, metal magnetic particles having an average particle diameter larger than that of the metal magnetic particles constituting the upper surface of the element body 2 exist, and in the region on the lower side with respect to the plane that is substantially orthogonal to the winding axis of the coil conductor 3 and is in contact with the lower end of the winding portion, metal magnetic particles having an average particle diameter larger than that of the metal magnetic particles constituting the lower surface of the element body 2 exist. In other words, in the coil component 1 of the fifth modification, the second magnetic layer 22 containing metal magnetic particles having a relatively large average particle diameter is not arranged only to the inside of the winding portion of the coil conductor 3, but also in the region on the upper side with respect to the plane that is substantially orthogonal to the winding axis of the coil conductor 3 and is in contact with the upper end of the winding portion and in the region on the lower side with respect to the plane that is substantially orthogonal to the winding axis of the coil conductor 3 and is in contact with the lower end of the winding portion. The coil component 1 of the fifth modification has an advantage that the inductance value is further increased as compared with the coil component 1 of the first modification.

[Sixth Modification]

Figure 9:
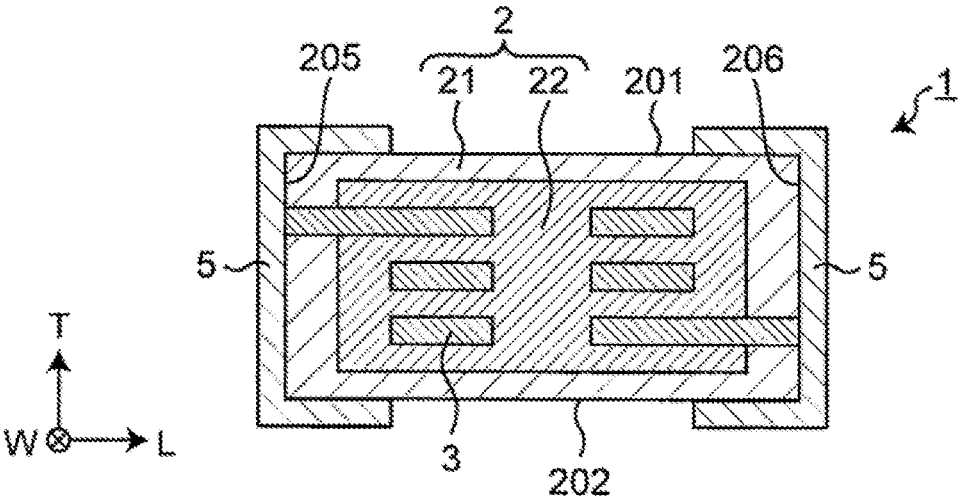
FIG. 9 is a cross-sectional view parallel to the LT plane, schematically showing a sixth modification of the coil component according to the embodiment of the present disclosure.
Figure 10:
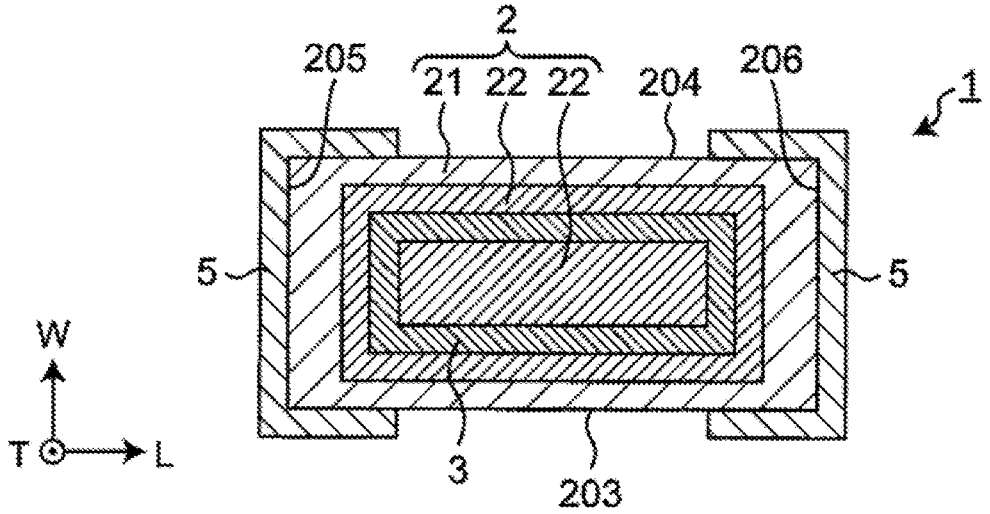
FIG. 10 is a cross-sectional view parallel to the LW plane, schematically showing the coil component of the sixth modification.

FIGS. 9 and 10 show a cross-sectional view parallel to the LT plane and a cross-sectional view parallel to the LW plane, schematically showing the coil component 1 of the sixth modification. The coil component 1 of the sixth modification is different from the coil component 1 of the second modification in that, in the region between the winding portion of the coil conductor 3 and the first side surface 203 of the element body 2, metal magnetic particles having an average particle diameter larger than that of the metal magnetic particles constituting the first side surface 203 exist, in the region between the winding portion of the coil conductor 3 and the second side surface 204, metal magnetic particles having an average particle diameter larger than that of the metal magnetic particles constituting the second side surface 204 exist, in the region between the winding portion of the coil conductor 3 and the third side surface 205, metal magnetic particles having an average particle diameter larger than that of the metal magnetic particles constituting the third side surface 205 exist, and in the region between the winding portion of the coil conductor 3 and the fourth side surface 206, metal magnetic particles having an average particle diameter larger than that of the metal magnetic particles constituting the fourth side surface 206 exist. In other words, in the coil component 1 of the sixth modification, the second magnetic layer 22 containing metal magnetic particles having a relatively large average particle diameter is arranged not only inside the winding portion of the coil conductor 3, but also in the region between the winding portion of the coil conductor 3 and the first side surface 203 of the element body 2, the region between the winding portion and the second side surface 204, the region between the winding portion and the third side surface 205, and the region between the winding portion and the fourth side surface 206. As compared with the coil component 1 shown in FIGS. 1 to 3 and the coil component 1 of the first to fifth modifications, the coil component 1 of the sixth modification has the largest volume occupied by the second magnetic layer 22, and has the highest inductance value.

[Seventh Modification]

FIG. 11 shows a cross-sectional view parallel to the LT plane, schematically showing the coil component 1 of the seventh modification. The coil component 1 of the seventh modification is different from the coil component 1 shown in FIGS. 1 to 3 in that the external electrodes 5 are L-shaped electrodes. In the coil component 1 of the seventh modification, the entire surface of the element body 2 is composed of the first magnetic layer 21 containing metal magnetic particles having a relatively small average particle diameter. Therefore, even when the external electrodes 5 are L-shaped electrodes as shown in FIG. 11, the occurrence of plating elongation can be further suppressed, and a higher inductance value can be attained.

[Eighth Modification]

FIG. 12 shows a cross-sectional view parallel to the LT plane, schematically showing the coil component 1 of the eighth modification. The coil component 1 of the eighth modification is different from the coil component 1 shown in FIGS. 1 to 3 in that the external electrodes 5 are bottom electrodes. In the coil component 1 of the eighth modification, the entire surface of the element body 2 is composed of the first magnetic layer 21 containing metal magnetic particles having a relatively small average particle diameter. Therefore, even when the external electrodes 5 are bottom electrodes as shown in FIG. 12, the occurrence of plating elongation can be further suppressed, and a higher inductance value can be attained.

[Method for Manufacturing Coil Component 1]

Next, a method for manufacturing the coil component 1 according to the embodiment of the present disclosure will be described below using the method for manufacturing the coil component 1 shown in FIGS. 1 to 3 as an example. However, the method for manufacturing the coil component 1 is not limited to the method described below.

(Preparation of Paste for First Magnetic Layer 21 and Paste for Second Magnetic Layer 22)

A predetermined amount of binder such as PVA (polyvinyl alcohol), PVB (polyvinyl butyral), and/or ethyl cellulose is added to metal magnetic particles having a predetermined particle diameter, and a solvent such as BCA (butyl carbitol acetate), BC (butyl carbitol), and/or terpineol is added and kneaded to obtain a paste for the first magnetic layer 21 and a paste for the second magnetic layer 22. The particle diameter of the metal magnetic particles used for the paste for the first magnetic layer 21 and the particle diameter of the metal magnetic particles used for the paste for the second magnetic layer 22 can be selected as appropriate so that the average particle diameter of the metal magnetic particles contained in the first magnetic layer 21 is smaller than the average particle diameter of the metal magnetic particles contained in the second magnetic layer 22 in the coil component 1 in a finished product. For example, the metal magnetic particles used for a paste for the first magnetic layer 21 may have a volume-based median diameter or average particle diameter smaller than those of the metal magnetic particles used for a paste for the second magnetic layer 22. The metal magnetic particles used for the paste for the first magnetic layer 21 preferably have a volume-based median diameter of 10% or more and 80% or less (i.e., from 10% to 80%) of that of the metal magnetic particles used for the paste for the second magnetic layer 22. More specifically, the metal magnetic particles used for the paste for the first magnetic layer 21 preferably have, for example, a volume-based median diameter of 2 μm or more and 16 μm or less (i.e., from 2 μm to 16 μm). The metal magnetic particles used for the paste for the second magnetic layer 22 preferably have, for example, a volume-based median diameter of 5 μm or more and 20 μm or less (i.e., from 5 μm to 20 μm). It should be noted that the relative magnitude relationship of the median diameter or average particle diameter of the metal magnetic particles contained in a paste for the first magnetic layer 21 and the paste for the second magnetic layer 22 and the relative magnitude relationship of the average particle diameters of the metal magnetic particles contained in the first magnetic layer 21 and the second magnetic layer 22 in the coil component 1 of the finished product do not change essentially. Further, the relative magnitude relationship of the metal magnetic particles can be considered to be essentially the same regardless of whether the median diameter or the average particle diameter is evaluated. The metal magnetic material constituting the metal magnetic particles is not particularly limited. For example, there may be used Fe—Si alloy, Fe—Si—Cr alloy, Fe—Si—Al alloy, Fe—Ni alloy, or a combination thereof. As the metal magnetic particles, commercially available products may be used as appropriate.

(Preparation of Paste for Coil Conductor)

A predetermined amount of binder such as PVA (polyvinyl alcohol), PVB (polyvinyl butyral), and/or ethyl cellulose is added to metal particles having a predetermined particle diameter, and a solvent such as BCA (butyl carbitol acetate), BC (butyl carbitol), and/or terpineol is added and kneaded to obtain a paste for a coil conductor. The average particle diameter of the metal particles is not particularly limited, and may be, for example, 0.5 μm or more and 10 μm or less (i.e., from 0.5 μm 10 μm). The metal material constituting the metal particles is not particularly limited, and may be a metal material generally used for a laminated element, such as Ag, Ag—Pd, Cu, Pt, or the like.

(Formation of Element Body 2 and Coil Conductor 3)

The paste for the first magnetic layer 21 or the paste for the second magnetic layer 22 and the paste for the coil conductor are alternately printed in layers, thereby forming the element body 2 in which the coil conductor 3 is arranged. By applying each paste using a screen plate, it is possible to arrange an arbitrary component at an arbitrary location in the element body. The obtained element body 2 is subjected to debinder treatment at a predetermined temperature in the atmosphere, and then heat-treated at 600° C. or more, preferably 600° C. or more and 800° C. or less (i.e., from 600° C. to 800° C.).

(Formation of External Electrode 5)

The external electrode 5 may be formed simultaneously when the coil conductor 3 and the element body 2 are formed, or may be formed after the element body 2 is heat-treated. When the external electrode 5 is formed after the element body 2 is heat-treated, for example, the external electrode 5 can be formed by applying a paste for an external electrode to both ends of the element body 2 after the heat treatment and then performing heat treatment (baking process). As the paste for an external electrode, for example, a paste containing metal such as Ag and Cu and glass frit can be used. The glass frit is added for the purpose of ensuring close-contact property between the element body 2 and the external electrode 5. The formed external electrode 5 may be plated. Plating is performed to connection to the outside by soldering or the like when the coil component 1 is mounted. Various types of plating can be applied depending on the purpose, and usually Ni—Sn plating or Cu—Sn plating can be applied. When the external electrode 5 is plated, in order to prevent a plating solution from entering the voids existing in the element body 2, the element body 2 may be impregnated with a resin to fill the voids. Since the coil component 1 according to the present embodiment can further suppress the occurrence of plating elongation, the accuracy of the shape and dimensions of the plating can be improved. In this way, the coil component 1 can be manufactured.

EXAMPLES (Preparation of Paste a and Paste B)

A paste A and a paste B containing metal magnetic particles were prepared by the procedure described below. As the metal magnetic particles of the paste A, Fe—Si alloy particles having a volume-based median diameter $D_{50}$ of 10 μm were used. As the metal magnetic particles of the paste B, Fe—Si alloy particles having a volume-based median diameter $D_{50}$ of 5 μm were used. A predetermined amount of ethylcellulose was added as a binder to each metal magnetic particle, and terpineol was added as a solvent to be kneaded to obtain the paste A and the paste B.

Each of the paste A and the paste B was laminated to a thickness of 1 mm to obtain a laminate. A sample for measuring relative permeability was produced by pressing the laminate at 450 MPa and processing it into a toroidal shape. A sample for measuring resistivity was produced by pressing the laminate at 450 MPa and processing it into a plate shape. The sample after the press processing was debindered in the atmosphere, and then heat-treated at 700° C. to obtain the sample for measuring relative permeability and the sample for measuring resistivity. The relative permeability and the resistivity at a frequency of 10 MHz were measured for each of the sample produced using the paste A (sample A) and the sample produced using the paste B (sample B). The test results are shown in Table 1.

TABLE 1

| | Metal magnetic particles Median diameter (μm) | Relative permeability | Resistivity (Ω · cm) |
|---|---|---|---|
| Sample A | 10 | 31 | $1 \times 10^7$ |
| Sample B | 5 | 20 | $1 \times 10^9$ |

As shown in Table 1, the sample A produced using metal magnetic particles having a median diameter of 10 μm has a higher relative permeability and a lower resistivity than the sample B produced using metal magnetic particles having a median diameter of 5 μm.

Example 1

Using the paste B as the paste for the first magnetic layer 21 and the paste A as the paste for the second magnetic layer 22, the coil component 1 of Example 1 having the structure shown in FIGS. 1 to 3 was produced. As a paste for a coil conductor, a paste obtained by adding a predetermined amount of ethyl cellulose as a binder to Ag particles and adding terpineol as a solvent thereto and kneading them was used. The paste for the first magnetic layer 21 (paste B) or the paste for the second magnetic layer 22 (paste A) and the paste for the coil conductor were alternately printed in layers, thereby forming the element body 2 in which the coil conductor 3 is arranged. The obtained element body 2 was pressed at 450 MPa, separated into pieces by cutting with a dicing machine, debinding at a predetermined temperature (400° C.) in the atmosphere, and then heat-treated at 700° C. An Ag paste was applied as a paste for an external electrode to the element body 2 after the heat treatment, and the external electrode 5 was formed by heat treatment. In order to fill the voids of the element body 2, the element body 2 was impregnated with an epoxy resin. Next, Ni plating and Sn plating were applied to the external electrode 5 to obtain a coil component 1 (inductor element) of 1.6 mm×0.8 mm×0.8 mm. In the coil component 1 of Example 1, as shown in FIG. 1, the element body 2 is composed of the second magnetic layer 22 (layer containing metal magnetic materials having a relatively large average particle diameter) arranged inside the winding portion of the coil conductor, and the first magnetic layer 21 (layer containing metal magnetic particles having a relatively small average particle diameter) arranged on the outside thereof.

Comparative Example 1

Figure 13:
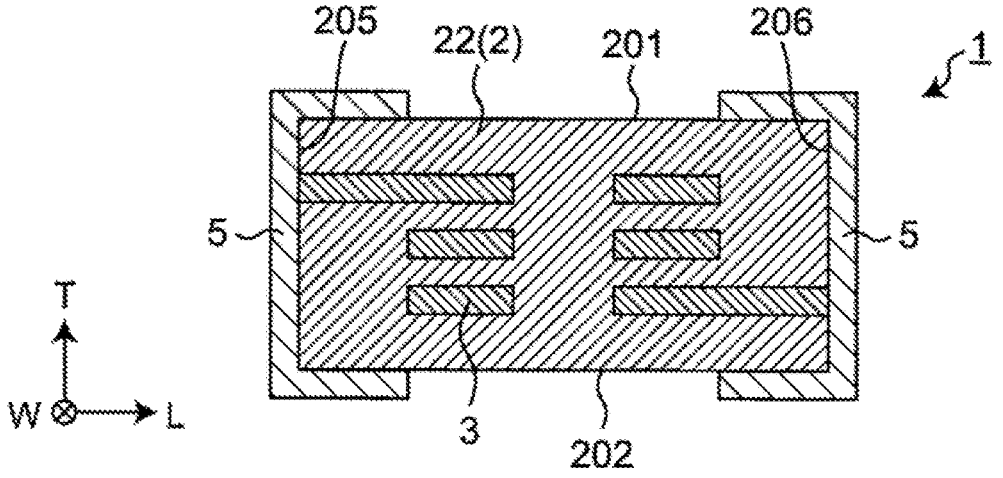
FIG. 13 is a cross-sectional view parallel to the LT plane, schematically showing a coil component of Comparative Example 1.
Figure 14:
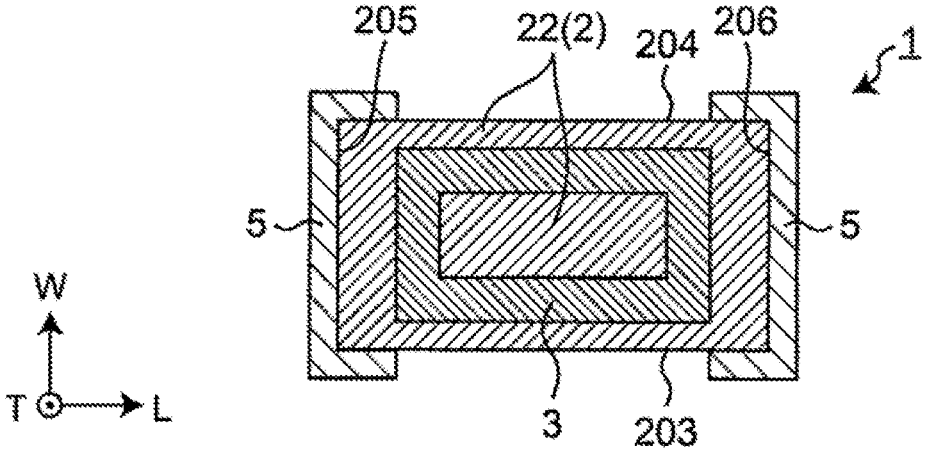
FIG. 14 is a cross-sectional view parallel to the LW plane, schematically showing the coil component of Comparative Example 1.

A coil component 1 of Comparative Example 1 having a structure as shown in FIGS. 13 and 14 was produced. The coil component 1 of Comparative Example 1 was produced in the same procedure as Example 1 except that the element body 2 was formed using only the paste A. In the coil component 1 of Comparative Example 1, as shown in FIGS. 13 and 14, the element body 2 is composed of only the second magnetic layer 22 (layer containing metal magnetic particles having a relatively large average particle diameter).

Comparative Example 2

Figure 15:
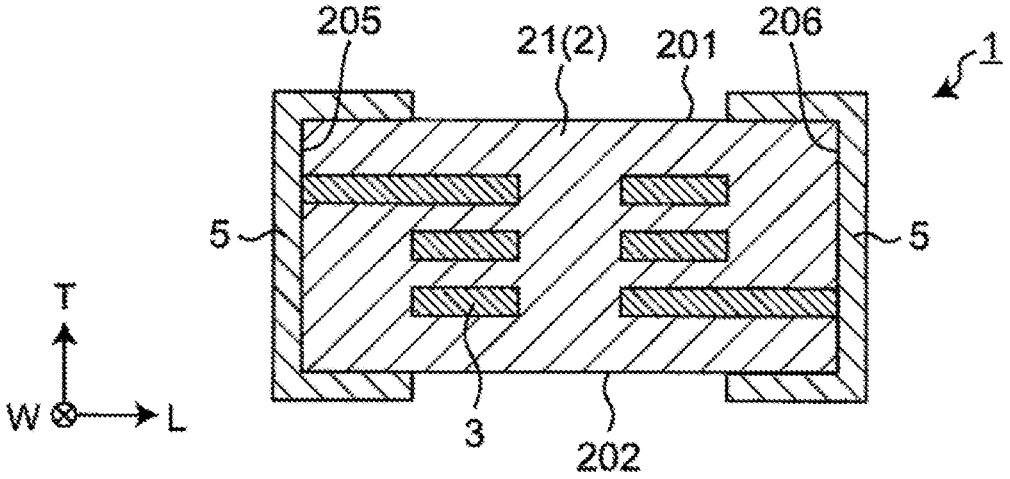
FIG. 15 is a cross-sectional view parallel to the LT plane, schematically showing a coil component of Comparative Example 2.

A coil component 1 of Comparative Example 2 having a structure as shown in FIG. 15 was produced. The coil component 1 of Comparative Example 2 was produced in the same procedure as in Example 1 except that the element body 2 was formed using only the paste B. In the coil component 1 of Comparative Example 2, as shown in FIG. 15, the element body 2 is composed of only the first magnetic layer 21 (layer containing metal magnetic particles having a relatively small average particle diameter).

(Measurement of Average Particle Diameter of Metal Magnetic Particles)

For each of Example 1, Comparative Example 1, and Comparative Example 2, the average particle diameter of the metal magnetic particles contained in the element body 2 was measured by the procedure described below. First, the coil component 1 was cut to form a cross section. The cross section was a plane cut parallel to the LT plane at a position of ½ of the width W of the coil component 1 or a plane cut parallel to the WT plane at a position of ½ of the length L of the coil component 1. The obtained cross section was mirror polished. An SEM image with a magnification of 1000 was acquired in the cross section after mirror polishing. For Example 1, an SEM image of the second magnetic layer 22 was acquired inside the winding portion of the coil conductor 3 (magnetic core portion), and an SEM image of the first magnetic layer 21 was acquired near the surface of the element body 2 outside the magnetic core portion. For Comparative Example 1 in which the element body 2 is composed only of the second magnetic layer 22, an SEM image of the second magnetic layer 22 was acquired at an arbitrary position in the cross section of the element body 2. For Comparative Example 2 in which the element body 2 is composed only of the first magnetic layer 21, an SEM image of the first magnetic layer 21 was acquired at an arbitrary position in the cross section of the element body 2.

The SEM image was binarized using image analysis software (A Image-kun (registered trademark) Ver 2.54, manufactured by Asahi Kasei Engineering Co., Ltd.), and the contours of the metal magnetic particles were extracted. At this time, only metal magnetic particles whose entire contour fall within the SEM image were analyzed. The equivalent circle diameters of the extracted metal magnetic particles were obtained, and the average value was taken as the average particle diameter of the metal magnetic particles. The test results are shown in Table 2.

(Measurement of Inductance Value and DC Resistance)

For each of Example 1, Comparative Example 1, and Comparative Example 2, an inductance value and a DC resistance $R_{dc}$ at 10 MHz were measured. The inductance value was measured using E4991A manufactured by Agilent Technologies (currently Keysight Technologies). The DC resistance $R_{dc}$ was measured using 4338B manufactured by Agilent Technologies (currently Keysight Technologies). The measurement of the inductance value and the DC resistance $R_{dc}$ was carried out with the number of samples n=50 for each example and comparative example, and the average values were taken as the inductance value and DC resistance $R_{dc}$, respectively. The results are shown in Table 2.

(Measurement of Rate of Occurrence of Plating Elongation)

For each of Example 1, Comparative Example 1, and Comparative Example 2, the appearance of the coil component 1 was visually observed to confirm the presence or absence of plating elongation. As shown in FIG. 16, one in which plating grows larger (indicated by symbol b) than the width of the external electrode 5 (indicated by symbol a) are counted as a defective product due to plating elongation. The appearance was confirmed with the number of samples n=100, and the rate of occurrence of plating elongation was obtained. The test results are shown in Table 2.

TABLE 2

| | Average particle diameter (μm) | | | | Rate of occurrence |
|---|---|---|---|---|---|
| | First magnetic layer | Second magnetic layer | Inductance (nH) | $R_{dc}$ (mΩ) | of plating elongation (%) |
| Example 1 | 3.51 | 7.13 | 95 | 20.0 | 2 |
| Comparative Example 1 | — | 7.54 | 100 | 20.7 | 80 |
| Comparative Example 2 | 3.29 | — | 90 | 19.4 | 3 |

As shown in Table 2, the coil component 1 of Example 1 in which the second magnetic layer 22 containing metal magnetic particles having a relatively large average particle diameter is arranged in the magnetic core portion, and the first magnetic layer 21 containing metal magnetic particles having a relatively small average particle diameter is arranged on the surface of the element body 2 attains a high rate of occurrence of plating elongation as compared to the coil component 1 of Comparative Example 1 in which the entire element body 2 is composed of the second magnetic layer 22 while ensuring a higher inductance value as compared to the coil component 1 of Comparative Example 2 in which the entire element body 2 is composed of the second magnetic layer 21. Further, the coil components 1 of Example 1, Comparative Example 1, and Comparative Example 2 had substantially the same DC resistance $R_{dc}$.

The present disclosure includes the following aspects, but is not limited to these aspects.

(First Aspect)

A coil component including: an element body including metal magnetic particles; a coil conductor arranged inside the element body; and a plurality of external electrodes arranged on a surface of the element body.

The element body has a substantially rectangular parallelepiped shape including an upper surface and a lower surface that are substantially orthogonal to a winding axis of the coil conductor, a first side surface and a second side surface that face each other, and a third side surface and a fourth side surface that face each other.

An average particle diameter of each of metal magnetic particles constituting the upper surface, metal magnetic particles constituting the lower surface, metal magnetic particles constituting the first side surface, and metal magnetic particles constituting the second side surface being smaller than an average particle diameter of metal magnetic particles existing inside a winding portion of the coil conductor.

(Second Aspect)

The coil component according to the first aspect, in which a region between a plane that is substantially orthogonal to the winding axis and is in contact with an upper end of the winding portion and the upper surface of the element body and a region between a plane that is substantially orthogonal to the winding axis and is in contact with a lower end of the winding portion and the lower surface of the element body each include metal magnetic particles having an average particle diameter smaller than the average particle diameter of the metal magnetic particles existing inside the winding portion.

(Third Aspect)

The coil component according to the first aspect, in which in a region on an upper side with respect to a plane that is substantially orthogonal to the winding axis and is in contact with an upper end of the winding portion, metal magnetic particles having an average particle diameter larger than the average particle diameter of the metal magnetic particles constituting the upper surface of the element body exist, and in a region on a lower side with respect to a plane that is substantially orthogonal to the winding axis and is in contact with a lower end of the winding portion, metal magnetic particles having an average particle diameter larger than the average particle diameter of the metal magnetic particles constituting the lower surface of the element body exist.

(Fourth Aspect)

The coil component according to any one of the first to third aspects, in which the coil conductor includes a plurality of conductor layers laminated in a winding axis direction and electrically connected to each other. Also, the average particle diameter of each of the metal magnetic particles constituting the upper surface, the metal magnetic particles constituting the lower surface, the metal magnetic particles constituting the first side surface, and the metal magnetic particles constituting the second side surface is smaller than an average particle diameter of metal magnetic particles existing between the conductor layers adjacent in the winding axis direction.

(Fifth Aspect)

The coil component according to any one of the first to fourth aspects, in which in a region between the winding portion of the coil conductor and the first side surface, metal magnetic particles having an average particle diameter larger than the average particle diameter of the metal magnetic particles constituting the first side surface exist, and in a region between the winding portion of the coil conductor and the second side surface, metal magnetic particles having an average particle diameter larger than the average particle diameter of the metal magnetic particles constituting the second side surface exist.

(Sixth Aspect)

The coil component according to any one of the first to fifth aspects, in which an average particle diameter of each of metal magnetic particles constituting the third side surface and metal magnetic particles constituting the fourth side surface is smaller than the average particle diameter of the metal magnetic particles existing inside the winding portion.

(Seventh Aspect)

The coil component according to the sixth aspect, in which in a region between the winding portion of the coil conductor and the third side surface, metal magnetic particles having an average particle diameter larger than the average particle diameter of the metal magnetic particles constituting the third side surface exist, and in a region between the winding portion of the coil conductor and the fourth side surface, metal magnetic particles having an average particle diameter larger than the average particle diameter of the metal magnetic particles constituting the fourth side surface exist.

(Eighth Aspect)

The coil component according to any one of the first to seventh aspects, in which the metal magnetic particles each have an oxide film on a surface, and the metal magnetic particles adjacent to each other are bonded to each other with the oxide film interposed therebetween.

(Ninth Aspect)

The coil component according to any one of the first to eighth aspects, in which the coil component is a laminated coil component.

Since the coil component according to the present disclosure has a higher inductance value and at the same time, the occurrence of plating elongation is further suppressed, the coil component can be widely used for applications that require high mounting accuracy.

What is claimed is:

1. A coil component comprising:

an element body including metal magnetic particles;

a coil conductor provided in the element body; and a plurality of external electrodes provided on a surface of the element body, the element body having a substantially rectangular parallelepiped shape including an upper surface and a lower surface that are substantially orthogonal to a winding axis of the coil conductor, a first side surface and a second side surface that face each other, and a third side surface and a fourth side surface that face each other, and an average particle diameter of each of metal magnetic particles constituting the upper surface, metal magnetic particles constituting the lower surface, metal magnetic particles constituting the first side surface, and metal magnetic particles constituting the second side surface being smaller than an average particle diameter of metal magnetic particles existing inside a winding portion of the coil conductor.

2. The coil component according to claim 1, wherein a first region between the upper surface of the element body and a plane that is in contact with an upper end of the winding portion and that is substantially orthogonal to the winding axis, a second region between the lower surface of the element body and a plane that is in contact with a lower end of the winding portion and that is substantially orthogonal to the winding axis, and each of the first region and the second region include metal magnetic particles having an average particle diameter smaller than the average particle diameter of the metal magnetic particles existing inside the winding portion.

3. The coil component according to claim 1, wherein in an upper side region with respect to a plane that is in contact with an upper end of the winding portion and that is substantially orthogonal to the winding axis, an average particle diameter of metal magnetic particles in the upper side region is larger than the average particle diameter of the metal magnetic particles constituting the upper surface of the element body, and in a lower side region with respect to a plane that is in contact with a lower end of the winding portion and that is substantially orthogonal to the winding axis, an average particle diameter of metal magnetic particles in the lower side region is larger than the average particle diameter of the metal magnetic particles constituting the lower surface of the element body.

4. The coil component according to claim 1, wherein the coil conductor includes a plurality of conductor layers laminated in a winding axis direction and electrically connected to each other, and the average particle diameter of each of the metal magnetic particles constituting the upper surface, the metal magnetic particles constituting the lower surface, the metal magnetic particles constituting the first side surface, and the metal magnetic particles constituting the second side surface is smaller than an average particle diameter of metal magnetic particles existing between the conductor layers adjacent in the winding axis direction.

5. The coil component according to claim 1, wherein an average particle diameter of metal magnetic particles existing in a region between the winding portion of the coil conductor and the first side surface is larger than the average particle diameter of the metal magnetic particles constituting the first side surface, and an average particle diameter of metal magnetic particles existing in a region between the winding portion of the coil conductor and the second side surface is larger than the average particle diameter of the metal magnetic particles constituting the second side surface.

6. The coil component according to claim 1, wherein an average particle diameter of each of metal magnetic particles constituting the third side surface and metal magnetic particles constituting the fourth side surface is smaller than the average particle diameter of the metal magnetic particles existing inside the winding portion.

7. The coil component according to claim 6, wherein an average particle diameter of metal magnetic particles existing in a region between the winding portion of the coil conductor and the third side surface, is larger than the average particle diameter of the metal magnetic particles constituting the third side surface, and an average particle diameter of metal magnetic particles existing in a region between the winding portion of the coil conductor and the fourth side surface, is larger than the average particle diameter of the metal magnetic particles constituting the fourth side surface.

8. The coil component according to claim 1, wherein the metal magnetic particles each have an oxide film on a surface, and the metal magnetic particles adjacent to each other are bonded to each other with the oxide film interposed therebetween.

9. The coil component according to claim 1, wherein the coil component is a laminated coil component.

10. The coil component according to claim 2, wherein the coil conductor includes a plurality of conductor layers laminated in a winding axis direction and electrically connected to each other, and the average particle diameter of each of the metal magnetic particles constituting the upper surface, the metal magnetic particles constituting the lower surface, the metal magnetic particles constituting the first side surface, and the metal magnetic particles constituting the second side surface is smaller than an average particle diameter of metal magnetic particles existing between the conductor layers adjacent in the winding axis direction.

11. The coil component according to claim 3, wherein the coil conductor includes a plurality of conductor layers laminated in a winding axis direction and electrically connected to each other, and the average particle diameter of each of the metal magnetic particles constituting the upper surface, the metal magnetic particles constituting the lower surface, the metal magnetic particles constituting the first side surface, and the metal magnetic particles constituting the second side surface is smaller than an average particle diameter of metal magnetic particles existing between the conductor layers adjacent in the winding axis direction.

12. The coil component according to claim 2, wherein an average particle diameter of metal magnetic particles existing in a region between the winding portion of the coil conductor and the first side surface is larger than the average particle diameter of the metal magnetic particles constituting the first side surface, and an average particle diameter of metal magnetic particles existing in a region between the winding portion of the coil conductor and the second side surface is larger than the average particle diameter of the metal magnetic particles constituting the second side surface.

13. The coil component according to claim 3, wherein an average particle diameter of metal magnetic particles existing in a region between the winding portion of the coil conductor and the first side surface is larger than the average particle diameter of the metal magnetic particles constituting the first side surface, and an average particle diameter of metal magnetic particles existing in a region between the winding portion of the coil conductor and the second side surface is larger than the average particle diameter of the metal magnetic particles constituting the second side surface.

14. The coil component according to claim 4, wherein an average particle diameter of metal magnetic particles existing in a region between the winding portion of the coil conductor and the first side surface is larger than the average particle diameter of the metal magnetic particles constituting the first side surface, and an average particle diameter of metal magnetic particles existing in a region between the winding portion of the coil conductor and the second side surface is larger than the average particle diameter of the metal magnetic particles constituting the second side surface.

15. The coil component according to claim 2, wherein an average particle diameter of each of metal magnetic particles constituting the third side surface and metal magnetic particles constituting the fourth side surface is smaller than the average particle diameter of the metal magnetic particles existing inside the winding portion.

16. The coil component according to claim 3, wherein an average particle diameter of each of metal magnetic particles constituting the third side surface and metal magnetic particles constituting the fourth side surface is smaller than the average particle diameter of the metal magnetic particles existing inside the winding portion.

17. The coil component according to claim 2, wherein the metal magnetic particles each have an oxide film on a surface, and the metal magnetic particles adjacent to each other are bonded to each other with the oxide film interposed therebetween.

18. The coil component according to claim 3, wherein the metal magnetic particles each have an oxide film on a surface, and the metal magnetic particles adjacent to each other are bonded to each other with the oxide film interposed therebetween.

19. The coil component according to claim 2, wherein the coil component is a laminated coil component.

20. The coil component according to claim 3, wherein the coil component is a laminated coil component.

* * * * *